US005834169A

United States Patent [19]

Thomas

[11] Patent Number: 5,834,169

[45] Date of Patent: Nov. 10, 1998

[54] METHOD OF DEVELOPING A PHOTOGRAPHIC PRODUCT WITH INCORPORATED DEVELOPER BY SURFACE APPLICATION

[75] Inventor: Francoise M. Thomas, Chalon Sur Saone, France

[73] Assignee: Eastman Kodak Company, Rochester, N.Y.

[21] Appl. No.: 932,670

[22] Filed: Sep. 18, 1997

[30] Foreign Application Priority Data

Sep. 18, 1996 [FR] France ..... 96 11570

[51] Int. Cl.[6] ..... G03C 1/42

[52] U.S. Cl. ..... 430/405; 430/264; 430/448

[58] Field of Search ..... 430/264, 405, 430/448

[56] References Cited

U.S. PATENT DOCUMENTS 4,269,929 5/1981 Nothnagle ..... 430/264

4,447,522 5/1984 Hirano et al. ..... 430/405

*Primary Examiner*—Hoa Van Le

*Attorney, Agent, or Firm*—J. Lanny Tucker

[57] ABSTRACT

The present invention concerns a novel method for developing silver halide photographic products. This method involves processing photographic products that have an incorporated developing agent, and a nucleation agent, by surface application of an activator solution. This method intended for processing graphic arts films having high contrast.

19 Claims, 2 Drawing Sheets

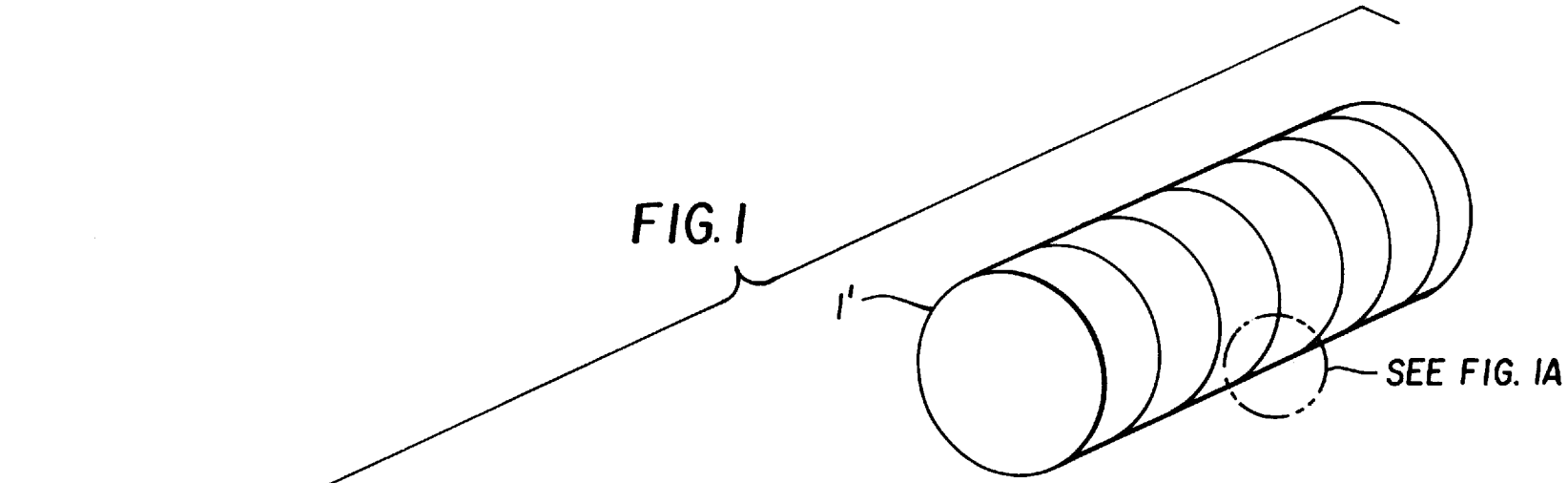
SEE FIG. 1A
1'
FIG. 1
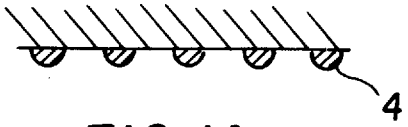
4
FIG. 1A
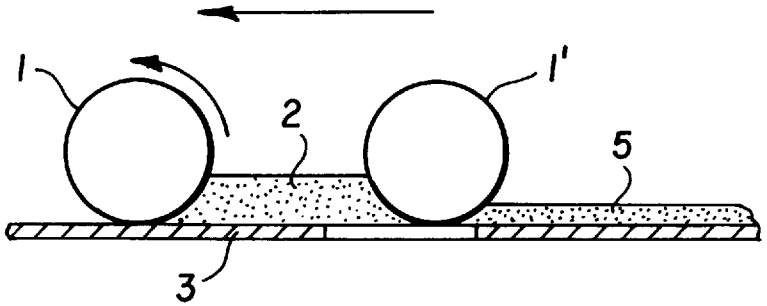
5
1'
2
3
1

METHOD OF DEVELOPING A PHOTOGRAPHIC PRODUCT WITH INCORPORATED DEVELOPER BY SURFACE APPLICATION

FIELD OF THE INVENTION

The present invention relates to a method of processing photographic products containing incorporated developing agents. In particular, it is a process for developing photographic products with incorporated developing agents and a nucleation agent using surface application of an activator solution. It also relates to an activator solution useful in this method.

BACKGROUND OF THE INVENTION

To develop photographic products, the exposed product is normally processed with a developer which comprises at least one silver halide developing agent, for example hydroquinone or hydroquinone derivatives. Conventionally, the exposed product is immersed in a developer, and is then immersed in a fixer, then in a washing bath. Over time, the active compounds in the developer are depleted and it thus becomes less efficacious, necessitating the use of a solution for maintaining the activity of the developer (replenisher).

This conventional technique requires large quantities of water and solution to be used. Furthermore, the destruction or recycling of these large volumes of solution leads to numerous problems, in particular in terms of protection of the environment. This problem is all the more significant as standards for disposing of chemical solutions are becoming more and more strict.

In order to reduce the problems related to the use of these conventional developers, the developing agents have been incorporated into one of the layers of the photographic product. Following exposure, these products with incorporated developing agents are developed using a basic solution, called an activator, which contains no developing agent. In general, the exposed photographic product is contacted with the activator in a conventional manner by immersing in a tank containing the activator solution.

FR-2,003,178 and FR-2,414,743, describe methods which consist of contacting the photographic product to be developed with a support, generally gelatin, that is impregnated with basic activator comprising an alkaline metal hydroxide (sodium hydroxide, potassium hydroxide).

In order to limit the problems related to the use of a large volume of solution, this technique would seem advantageous. This technique of development by impregnation considerably limits the volume of processing solution used in development, and consequently all the problems of recovery, recycling or destruction of photographic solutions. However, these techniques necessitate complex additional processing steps, such as, for example, the conditioning of the activator on the layer of gelatin. Additionally, this technique does not give satisfactory sensitometric results, in particular for photographic products intended for the field of graphic arts that must have high contrast.

For many years, films and development processes intended for the graphic arts industry, have been designed to obtain an improved image quality by virtue of high contrast.

It is known to obtain such films with silver halide photographic emulsions containing a majority of silver chloride, and which can be developed with a hydroquinone developer containing a small quantity of sulfite. This type of developer has drawbacks, such as a lack of solution stability.

It is also known to obtain high-contrast films by using hydrazine compounds, either in the photographic film or in the developer. For example, U.S. Pat. No. 4,269,929 describes a method of developing a photographic product for graphic arts, in the presence of a hydrazine compound, with an alkaline developing solution that has a pH above 10 and below 12 and which contains dihydroxybenzene and 3-pyrazolidinone, sulfite as a preservative and an amino compound (or booster) to promote contrast.

Developers comprising hydrazine and amino compounds are known in the prior art for the purpose of increasing the contrast of photographic films destined for the graphic arts industry. Though very promising, this technique exhibits drawbacks because certain amino compounds are toxic, or too volatile. They sometimes have a tendency to form an azeotrope with water or exhibit solubility problems in photographic developers.

It has been attempted to overcome these drawbacks by incorporating the amino compound and/or the hydrazine compound into the photographic product. The properties of these systems are in particular highly dependent on the processing conditions. That is to say, variable sensitometric results are obtained depending upon the pH of the processing solution, the halide concentration of this solution, or the level of agitation of the processing solution.

SUMMARY OF THE INVENTION

One of the objects of the present invention is to provide a rapid-access process for developing a photographic product containing an incorporated developer which requires a minimal quantity of activator for the development of an image.

A second object of the present invention is to obtain, by using a small volume of activator, good sensitometric results, and in particular high contrast in the developed products.

Another object of the invention is to provide a method of developing photographic products which is simple to set up, and which avoids the handling of a large volume of solution.

The problems noted above are overcome with a method for processing an exposed silver halide photographic product comprising a support having thereon a silver halide emulsion layer, the method comprising applying to the photographic product, a layer of an activator, wherein A. the photographic product comprises:

(1) a hydrazine nucleation agent, (2) an incorporated amino booster, and (3) a developing agent for silver halides capable, in its oxidized form, of oxidizing hydrazine, and B. the activator being a homogeneous aqueous solution of (a) an alkanolamine in a quantity greater than or equal to 0.6 mol/l, (b) a quaternary ammonium salt, (c) at least one high pH resistant wetting agent miscible in the activator and (d) a nitroindazole anti-fog compound.

This invention also provides an activator for the development of a silver halide photographic product with an incorporated developer, comprising an aqueous solution of (a) an alkanolamine in a quantity greater than or equal to 0.6 mol/l, (b) 0.1 to 20 g/l of a quaternary ammonium salt, (c) 0.1 to 3% by volume of activator with at least one high pH resistant wetting agent miscible in the activator, and (d) a nitroindazole anti-fog compound.

BRIEF DESCRIPTION OF THE DRAWINGS

FIGS. 1 and 2 are diagrammatic depictions of devices for surface application of the activator.

DETAILED DESCRIPTION OF THE INVENTION

Figure 2:
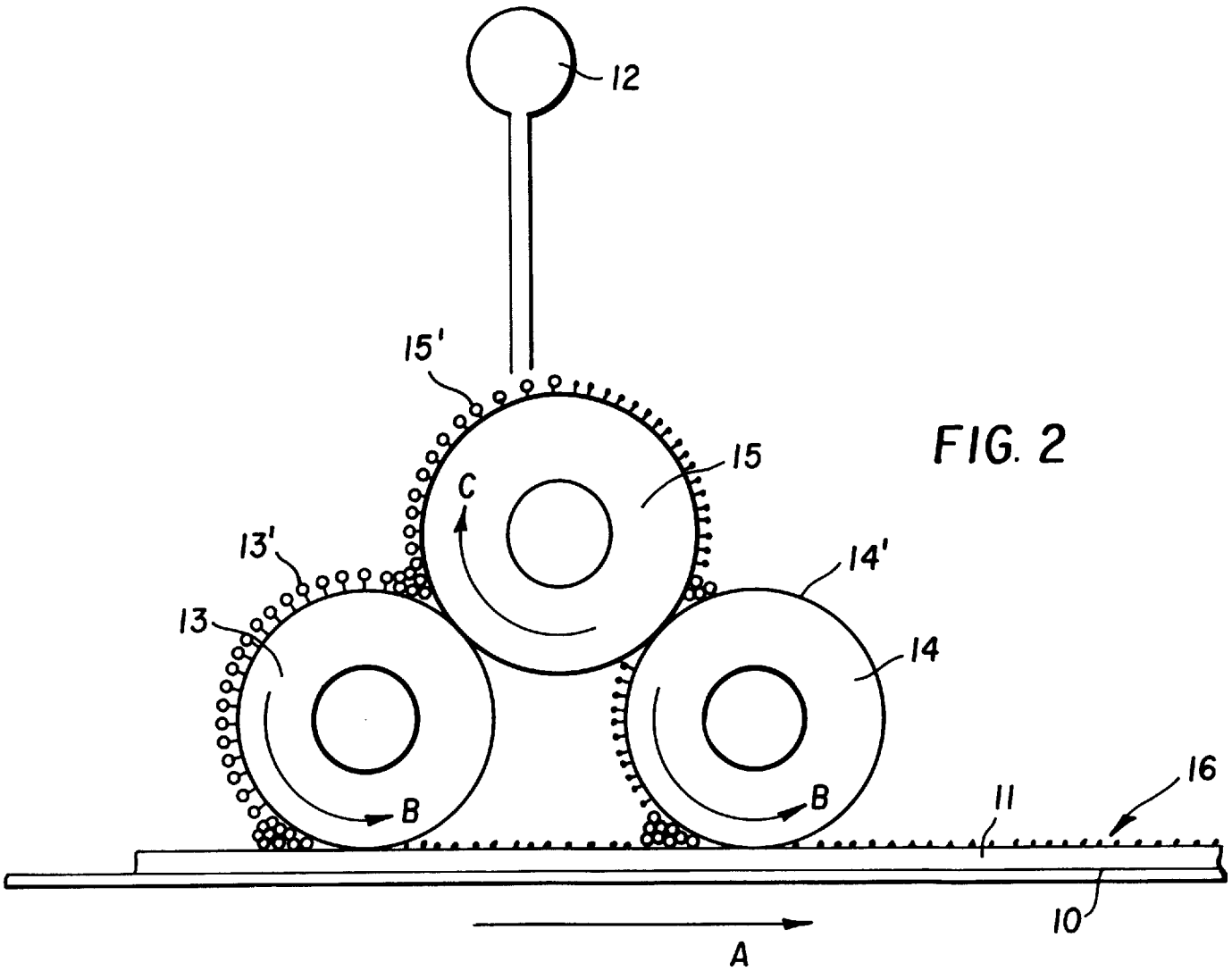

The present invention is a method of developing a photographic product by the surface application of an activator solution, that is to say the photographic product is not immersed in a tank filled with activator solution, but its face opposite the support is contacted or covered with a layer of activator.

The activator solution can be applied by any known means enabling an aqueous solution to be applied uniformly to a flat support so as to form a thin layer. This application can be carried out manually or automatically.

This method enables photographic products to be developed rapidly with a very low volume of activator solution. In particular, it enables high-contrast photographic products to be processed, for example photographic products useful for the graphic arts.

According to the invention, it is possible to develop photographic products with a volume of activator solution of between 20 and 200 ml/m$^2$ and preferably between 20 and 50 ml/m$^2$ of photographic product to be developed.

In conventional tank-based development methods, the same development bath is used to treat a large number of photographic products. The chemical composition of this bath alters over time, leading to sensitometric variations between photographic products processed with a new bath and a seasoned bath. This drawback can be eliminated by using replenishers.

The present invention eliminates sensitometric variations due to variations in the halide concentration of the developer. This is because the present invention enables photographic products to be developed with an activator solution whose halide concentration does not change since the portion of activator solution, applied in a thin layer, is used only once.

Furthermore, by virtue of the application of the activator as a thin layer, the problems of recycling and destroying photographic effluents, and the sensitometry problems related to the stirring of development baths, are reduced or avoided.

This method reduces the ecological impact of development baths by virtue of the low volume of activator which is used. It also reduces the quantities of chemical product used.

According to one embodiment, the activator solution is applied by means of the device shown in FIG. 1, that comprises 2 rollers 1 and 1' connected together and forming a reservoir containing the activator to be spread 2, the whole being placed on the surface of the film 3 to be developed. Front roller 1 is covered with a flexible rubber, and the back roller 1' is a roller with a ribbed surface 4 enabling the spreading of the thin layer of activator 5 to be controlled. The device is equipped with means (not shown) of automatically moving the device over the film, which enables a uniform layer of activator (not visible in the figure) to be deposited on the film.

According to another embodiment, the activator solution is applied by means of the device described in FR 2739199 published Mar. 28, 1997. This device, shown in FIG. 2, comprises surface 10 supporting the photographic product to be developed 11, a means of transporting the photographic product (not shown), reservoir 12 which delivers a given quantity of activator, a means of applying the activator which comprises at least two bottom rollers 13 and 14 in contact with the photographic product to be developed, and top roller 15 situated above each of two bottom rollers 13 and 14, the top roller 15 being in contact with the bottom rollers 13 and 14. The activator is deposited on the surface of roller 15' and then flows onto the surface of bottom rollers 13' and 14'. When the photographic product is moved in the direction of the arrow (A), bottom rollers 13 and 14 are rotated as indicated by the arrows (B, C), which causes the rotation of upper roller 15. This rotation deposits a thin layer 16 of activator on the film to be developed, as FIG. 2 shows.

The invention also provides an activator solution which is a homogeneous aqueous solution which comprises (a) an alkanolamine in a quantity greater than or equal to 0.6 mol/l, (b) 0.1 to 20 g/l of a quaternary ammonium salt, (c) 0.1 to 3% by volume of activator with at least one high pH resistant wetting agent miscible in the activator, and (d) a nitroindazole anti-fog agent.

The alkanolamine useful in the present invention is a primary, secondary or tertiary amine comprising a linear or branched hydroxyalkyl group having 1 to 10 carbon atoms. The alkanolamine can be chosen from amongst monoethanolamine, diethanolamine, 2-alkylethanolamines, 2-methylethanolamine, 2-ethylethanolamine, diethyl-N-N-aminoethanol, 3-aminopropanol, 2-amino-1-propanol, 4-amino-1-butanol, 2-amino-1-butanol, 3-diethyl-1-amino-1-propanol, 1-dimethylamino-2-propanol, 2-dimethylaminoethanol, N-ethyldiethanolamine, N-phenyldiethanolamine, triethanolamine, etc. These alkanolamines can be used in a mixture.

According to the invention, the alkanolamine concentration is between 0.6 and 2 mol/l, and preferably 0.8 to 1.5 mol/l.

The activator solution of the present invention is a strongly basic homogeneous aqueous solution. The pH of the activator must be greater than 10.

Since alkanolamine is a buffer compound (pKa of about 12), it is only possible to reach a pH above 12 with very large quantities of alkanolamine. If activators are to be used which have pH values above 12, it is preferable, rather than adding large quantities of alkanolamine, to adjust the pH through the addition of a strong base, for example potassium hydroxide. For sensitometric and ecological reasons, it is, however, preferable to use an activator which has a pH below 13.

According to the present invention, the activator solution comprises at least one wetting agent forming with the activator a stable and homogeneous solution. In the context of the present invention, "wetting agent" means a surfactant which facilitates the spreading of the activator over the film and which assists chemical exchanges between the activator and the photographic product to be processed. This wetting agent facilitates the penetration and diffusion of the chemical substances in the activator to the layer containing the developer.

This agent must give a uniform layer of activator on the photographic product to be developed. This is because it is very important, in the context of the present invention, to obtain a uniform layer of activator over the whole surface of the film to be processed. Parts of the film not covered by this layer must not appear following application of the activator.

The wetting agent must be miscible in the basic activator, that is to say it must form a homogeneous solution with the other compounds present in the activator. It must be stable over time in a strongly basic medium. Furthermore, the wetting agent must be photographically inert. It must not, for example, have an effect on fogging, speed, storage of films, etc. This is because the activator must be able to be stored without losing these properties of development or spreading.

By way of example, these wetting agents can be anionic, cationic, non-ionic or amphoteric surfactants, alone or in a mixture. These surfactants are, for example, ZONYL FSN® and ALKANOL XC® manufactured by Dupont, LODYNE S-100® manufactured by Ciba-Geigy and OLIN 10G® manufactured by Olin Mathieson.

The activator solution also contains a quaternary ammonium salt. These quaternary salts are represented by the following formula:

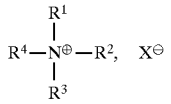

(I)

in which $R^1$, $R^2$, $R^3$ and $R^4$ are independently hydrogen, an alkyl group having 1 to 4 carbon atoms, an aromatic group which may contain one or more nitrogen atoms, or the groups $R^1$ and $R^2$ together, or $R^1$, $R^2$ and $R^3$ together can also represent the atoms or bonds needed to form a ring, aromatic or otherwise, having 5 or 6 atoms in the ring.

X is the counter-ion which balances the charge of the molecule. X can, for example, be a halide or a sulfonate.

The quantity of quaternary ammonium salt is between 0.1 and 20 g/l, and preferably between 1 and 10 g/l.

These quaternary ammonium salts can, for example, be 1-phenethyl-2-methyl pyridinium bromide, 2-phenethyl-1-pyridinium bromide, 1-phenethyl-2-pyridinium bromide, 2,6-dichlorobenzyl-1-pyridinium bromide, benzyltriethylammonium chloride, tetrabutylammonium perchlorate, 1,4-dimethylpyridinium p-toluene sulphonate, 1-methyl-2-propynyl-2-pyrydinium bromide or tetrapropyl ammonium chloride.

According to a preferred embodiment, the quaternary ammonium salt is a salt of formula (I) in which at least one of the groups $R^1$, $R^2$ and $R^3$ is an aryl group. According to another preferred embodiment, the quaternary ammonium salt is a salt of formula (I) in which $R^1$, $R^2$ and $R^3$ together represent the atoms required to form a pyridinium heterocyclic ring. According to one embodiment of the invention, the ammonium salt is 1-phenethyl-2-methylpyridinium.

The activator solution of the present invention also contains a nitroindazole anti-fog compound. This anti-fog compound can be chosen from amongst 5-nitroindazole or 6-nitroindazole compounds. The quantity of indazole compound is between 0.05 and 0.7 g/l, and preferably between 0.1 and 0.5 g/l.

The activator of the present invention can also contain other compounds such as for example preservatives, bactericides, fungicides, sequestering agents or buffer compounds. Examples of these compounds are described in *Research Disclosure*, September 1994, 365, No 36544 (referred to hereinafter as *Research Disclosure*), Section XIX.

According to a preferred embodiment, the activator is free of silver halide developing agent.

In practicing this invention, it is possible to incorporate any hydrazine compound functioning as a nucleation agent into the photographic material to be processed. The hydrazine compound can be incorporated into the silver halide emulsion layer, but it can also be present in an intermediate layer consisting essentially of hydrophilic colloid. This intermediate layer is preferably adjacent to the silver halide emulsion layer in which the nucleation of the grains of silver halides is to be obtained. The intermediate layer can be a sub-layer, an inter-layer or a top-layer.

A particularly preferred class of hydrazine compounds is described in U.S. Pat. No. 4,912,016 (Machonkin et al). These compounds are aryl-hydrazides with the formula:

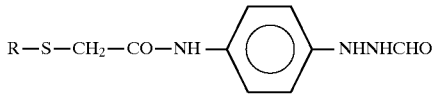

in which R is an alkyl or cycloalkyl group.

Another particularly preferred class of hydrazine compounds to be used in the photographic products of this invention are represented by one of the following formulae:

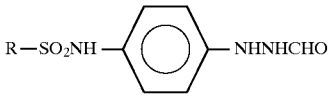

or

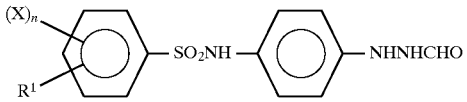

in which:

R is an alkyl group having 6 to 18 carbon atoms or a heterocyclic compound of 5 to 6 atoms in the ring, including sulfur or oxygen atoms;

$R^1$ is an alkyl or alkoxy group with 1 to 12 carbon atoms;

X is an alkyl, thioalkyl or alkoxy group with approximately 1 to 5 carbon atoms; a halogen; or —$NHCOR^2$, —$NHSO_2R$ , —$CONR^2R^3$, —$SO_2NR^2R^3$ where $R^2$ and $R^3$, which can be identical or different from each other, are hydrogen or an alkyl group with approximately 1 to 4 carbon atoms; and n is 0, 1 or 2.

The alkyl groups represented by R can be straight or branched, and can be substituted or unsubstituted. The substituents of these groups comprise alkoxy groups with 1 to 4 carbon atoms, halogen atoms (for example chlorine and fluorine) or —$NHCOR^2$ or —$NHSO_2R^2$ where $R^2$ is as defined previously. The preferred alkyl groups R contain 8 to 16 carbon atoms, since alkyl groups of this size confer greater insolubility on the hydrazide nucleation agents and consequently reduce the tendency for these agents to disperse into the photographic product or into the photographic developer.

When R is a heterocyclic compound, it can be a thienyl or furfuryl group, such group being able to be substituted by an alkyl group with 1 to 4 carbon atoms or by halogen atoms, such as chlorine.

The alkyl or alkoxy groups represented by $R^1$ can be straight or branched and can be substituted or unsubstituted. The substituent on these groups can be alkoxy groups with approximately 1 to 4 carbon atoms, halogen atoms (for example chlorine or fluorine); or —$NHCOR^2$ or —$NHSO_2R^2$ where $R^2$ is as defined previously. The preferred alkyl or alkoxy groups contain 1 to 5 carbon atoms, in order to confer sufficient insolubility on the hydrazide nucleation agents and reduce their tendency to disperse into the layers of the photographic product or into the developer.

The alkyl, thioalkyl and alkoxy groups represented by X contain approximately 1 to 5 carbon atoms and can have a straight or branched chain. When X is a halogen, it can be chosen from amongst chlorine, fluorine, bromine or iodine. When a number of X groups are present, they can be identical or different.

Another particularly preferred class of hydrazine compounds is described in U.S. Pat. No. 4,988,604 (Machonkin et al). These compounds are aryl sulfonamidophenyl hydrazides containing both thio and ethyleneoxy groups having the formula:

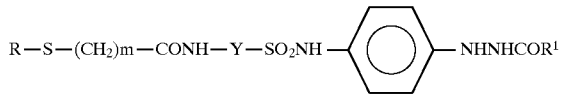

in which R is a monovalent group having at least 3 ethyleneoxy units, m is an integer between 1 and 6, Y is a substituted or unsubstituted divalent aromatic radical, and $R^1$ is hydrogen or a blocking group. The divalent aromatic radical represented by Y, such as a phenylene or naphthalene radical, can be substituted with one or more alkyl, halo, alkoxy, haloalkyl or alkoxyalkyl groups.

Although certain preferred hydrazine compounds of use in this invention have been described more specifically above, all hydrazine nucleation agents known in the art of the invention are included within the terms of the invention. Numerous nucleations agents are described in "Development Nucleation By Hydrazine and Hydrazine Derivatives", *Research Disclosure*, Article 23510, Vol 235, 10 Nov. 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,975,354, 4,988,604, 4,994,365 and 5,041,355.

The hydrazine compound used as a nucleation agent in this invention is generally present in a quantity between 0.003 millimoles and 100 millimoles per mole of silver, and more generally between 0.1 millimoles and 10 millimoles per mole of silver.

The photographic product used in this invention is an element comprising a nucleation agent of the hydrazine type as described previously and an amino-type incorporated booster.

Monoamines, diamines and polyamines can be used in this invention as an incorporated booster. The amines can be aliphatic amines or can comprise aromatic or heterocyclic groups.

The aliphatic, aromatic and heterocyclic groups present in the amines can be substituted groups or unsubstituted. Preferably, the amino compounds used in this invention as an incorporated booster are compounds that have at least 20 carbon atoms.

Amino compounds which are particularly efficacious as incorporated boosters are described in U.S. Pat. No. 4,975,354 (Machonkin et al).

The amino compounds described in this patent are amino compounds which:

(1) comprise at least one tertiary or secondary amine group;

(2) contain in their structure a group formed from at least three ethyleneoxy units, and (3) have a partition coefficient (as defined hereinafter) of at least one, preferably at least 3, and more preferably at least 4.

The preferred amino compounds used as an incorporated booster are tertiary diamines which have a partition coefficient of at least 3 and the formula:

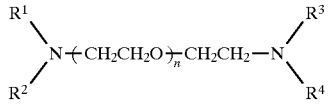

in which n is an integer between 3 and 50, and preferably between 10 and 50, $R^1$, $R^2$, $R^3$ and $R^4$ are independently alkyl groups of 1 to 8 carbon atoms, or $R^1$ and $R^2$ taken together, represent the atoms needed in order to form a heterocyclic ring.

Other amino compounds useful as incorporated boosters are secondary diamines that have a partition coefficient of at least 3 and the formula:

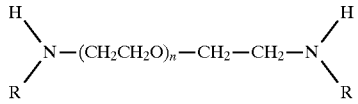

in which n is an integer between 3 and 50, and preferably between 10 and 50, and each group R is independently an alkyl group with a straight or branched chain, substituted or otherwise with at least 4 carbon atoms.

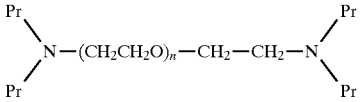

in which Pr represents n-propyl.

The amino compound used as an incorporated booster is generally present in a quantity of between 0.1 and 25 mmoles per mole of silver, and preferably between 0.5 and 15 mmoles per mole of silver.

The term "partition coefficient" as used here relates to the value Log P of the compound with respect to the n-octanol/water system defined by the equation:

$$Log\ P = Log\ ([X]_{n\text{-}octanol}/[X]water)$$

in which X is the concentration of the compound. The partition coefficient is a measurement of the capacity of a compound to be partitioned between an aqueous phase and an organic phase and this coefficient is calculated according to the method described by Leo et al, *Journal of Medicinal Chemistry*, Vol 18, No 9, pages 865–868, 1975. The higher the value of Log P, the more hydrophobic the compound. Compounds with a Log P above 0 are hydrophobic, that is to say they are more soluble in organic media than in aqueous media, while compounds having a log P below 0 are hydrophilic.

Since the photographic products useful in this invention contain a hydrazine compound functioning as a nucleation agent, and an amino compound functioning as an accelerator, it is not necessary to use such compounds in the developing solution.

The photographic product is one in which the developing agent has been incorporated into one of its layers. The developing agent which can be used in the context of the present invention is a silver halide developer able, in its oxidized form, to oxidize the hydrazine compound functioning as a nucleation agent.

Without being bound by theoretical considerations, it would appear that a developing agent is useful in the invention, if it is not an excessively powerful reducing agent. This is because, when the developer is highly reducing, its oxidized form is not highly active and is not, therefore, capable of oxidizing hydrazine. Consequently, nucleation is unable to take place. Furthermore, the lifespan of the oxidized form needs to be sufficiently long to permit reaction with the nucleation agent.

Since the developer fits the criteria defined above, that is to say it is capable in its oxidized form of oxidizing hydrazine, the developing agents able to be used in the context of the invention can be chosen from amongst conventional developing agents, on their own or in a mixture, for example aminophenols, polyhydroxybenzenes, such as para-dihydroxybenzenes, for example hydroquinone or hydroquinone derivatives, 3-pyrazolidinones, etc.

According to one particular embodiment, the developing agent can be hydroquinone or methylhydroquinone.

The quantity of developing agent that is incorporated into the photographic product depends on the silver content of the light-sensitive layer of silver halide emulsion. The Developer/Ag molar ratio is generally above 1:4. According to one embodiment, it is between 1:4 and 1:2.

It is often useful in systems with incorporated developing agents to use a co-developer which, in association with the developing agent, produces a synergy effect on the development. The quantity of this co-developer is, in general, much lower than the quantity of the main developing agent. The ratio by weight of the developing agent to the co-developer is generally between 20:1 and 3:1, preferably 10:1 and 5:1.

The most frequently used co-developers include aminophenols, such as ELON® (methyl-p-aminophenol sulphate), 1-phenyl-3-pyrazolidinones or phenidones, such as phenidone-A (1-phenyl-3-pyrazolidinone), B-phenidone (1-phenyl-4-methyl-3-pyrazolidinone), dimezone (1-phenyl-4,4'-dimethyl-3-pyrazolidinone), dimezone-S (1-phenyl-4-methyl-4'-hydroxymethyl-3-pyrazolidinone), 1-phenyl-4-hydroxymethyl-4'-hydroxymethyl-3-pyrazolidinone; blocked phenidones. Additional representative examples of aminophenols and phenidones are described in U.S. Pat. Nos. 2,688,549, 2,691,589, 3,865,591, 4,269,929, 4,840,879 and 5,236,816, and in the article by Ficken et al, *The Journal of Photographic Science*, Vol 11, 1963, pages 157–164.

It is possible to incorporate the developing agent and/or co-developer in any layer of the photographic product. It is, however, preferable not to incorporate the developing agent into the silver halide emulsion layer in order to avoid harmful reactions between it and the silver halide grains, before or after exposure. According to a preferred embodiment, the developing agent is incorporated into a layer adjacent to the silver halide emulsion layer. Preferably, this layer is situated between the support and the silver halide emulsion layer.

According to a preferred embodiment, the developing agent and/or co-developer, the hydrazine compound and the amino compound are incorporated into an intermediate layer of hydrophilic colloid situated between the silver halide emulsion layer and the support.

The silver halide emulsion layer consists of silver halide grains in a hydrophilic binder, for example gelatin. The various methods of preparing these emulsions were described in *Research Disclosure*, September 1994, 365, No 36544 (referred to hereinafter as *Research Disclosure*) section I–C.

Silver halide grains, when emulsions are used in products for graphic art, have an average grain size not in excess of approximately 0.7 $\mu$m, and preferably approximately 0.4 $\mu$m or less. The photographic emulsions can be applied in order to form layers of emulsions in the photographic elements with any conventional silver content.

In a manner well known in the art, it is possible to obtain higher contrasts by using relatively monodisperse emulsions. Monodisperse emulsions are characterized by a large proportion of silver halide grains with a relatively narrow frequency-size distribution. In quantitative terms, monodisperse emulsions are emulsions in which 90% by weight or by number of the silver halide grains represent more or less 40% of the average size of the grains.

The silver halide emulsions contain, apart from the silver halide grains, a binder.

The binders of emulsions can consist of hydrophilic colloids. Suitable hydrophilic substances comprise both natural substances, such as proteins, protein derivatives, cellulose derivatives, for example cellulose esters, gelatin, for example gelatin treated by a base (pigskin gelatin), gelatin derivatives, for example acetylated gelatin, phthalated gelatin, polysaccharides, such as dextran, gum arabic, zein, casein, pectin, collagen derivatives, collodion, agar-agar, arrowroot and albumin.

Apart from hydrophilic colloids, the binder of the emulsion can optionally consist of synthetic polymer substances insoluble in water or only slightly soluble in water, such as polymer latexes. These substances can act as additional peptizers and as carriers, and they also confer increased dimensional stability on the photographic elements. The synthetic polymer substances can be present in a weight ratio with the hydrophilic colloids of up to 2:1. It is generally preferred that the synthetic polymer substances make up approximately 20 to 80% by weight of the binder.

Suitable synthetic polymer substances can be chosen from amongst polyvinyl lactams, acrylamide polymers, polyvinyl alcohol and derivatives thereof, polyvinyl acetals, polymers of acrylates and alkyl and sulfoalkyl methacrylates, hydrolyzed polyvinyl acetates, polyamides, polyvinyl pyridines, acrylic acid polymers, maleic acid copolymers, polyoxyalkylenes, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, alkyleneimine copolymers, polyamines, N,N-dialkylaminoalkyl acrylates, vinylimidazole copolymers, vinyl sulfide copolymers, halogenated styrene polymers, aminoacrylamide polymers, polypeptides, etc.

The binders described in the emulsions are also of use in the formation of sub-layers, interlayers and top layers of the photographic products of the invention. Generally, the binders are tanned by means of one or more tanning agents, such as those described in *Research Disclosure*, Section II B.

The emulsions according to this invention comprise silver halide grains of any conventional geometric shape (for example regular cubic or octahedral crystalline shape) and able to be prepared using various techniques, for example single jet, double jet or accelerated and interrupted precipitation techniques as described by Trivelli et al, in *The Photographic Journal*, Vol LXXIX, May 1939, pp. 330–338; by T E James, *The Theory of the Photographic Process,* 4th ed, Macmillan 1977, Chapter 3, and in *Research Disclosure*, Section I.

*Research Disclosure* section 1-A also describes the silver halide compositions of these grains. The silver halide grains can consist of chloride, bromide, chlorobromide, bromochloride, chloroiodide, bromoiodide or bromochloroiodide.

In the field of graphic arts, the use of doped silver halide grains is preferred. In a manner known in the art, the use of an appropriate doping agent while using a hydrazine compound acting as a nucleation agent affords a high contrast. Doping agents are generally added during the crystalline growth of the silver halide grains, for example during the initial precipitation and/or the physical maturation of the silver halide grains. Rhodium is a particularly efficacious doping agent which can be incorporated into the grains in the form of appropriate salts, such as rhodium trichloride.

Silver halide emulsions can be sensitized chemically by means of active gelatin, as described by T E James in *The Theory of the Photographic Process,* 4th ed, Macmillan 1977, pp 67–76, or by means of sensitizers based on sulfur, selenium, tellurium, platinum, gold, palladium, iridium, osmium, rhenium or phosphorus sensitizers or combinations of these sensitizers. Such chemical sensitizers were described in *Research Disclosure*, Section IV.

The particularly preferred method enabling the compounds to be chemically sensitized consists of using a combination of a compound consisting of gold and a moderate chalcogen 1,1,3,3-tetrasubstituted moyen urea compound in which at least one substituent comprises a nucleophilic centre. This method affords exceptional results when used with silver halide emulsions with a high chloride content, that is to say those in which at least the surface part of the silver halide grains consists of over 50% molar silver chloride. The combination of the gold-based compound and the urea compound heightens sensitivity and increases the contrast at the foot of the sensitometric curve, without simultaneously increasing the fog. The use of a combination of potassium tetrachloroaurate and 1,3-dicarboxymethyl-1, 3-dimethyl-2-thiourea is particularly efficacious.

The silver halide emulsions can be sensitized spectrally by means of spectral dyes of the polymethine type, which comprise cyanines, merocyanines, complex cyanines and merocyanines (that is to say tri- tetra- and polynuclear cyanines and merocyanines), oxonols, hemioxonols, styryls, merostyryls and streptocyanines.

The silver halide grains can be spectrally sensitized as described in *Research Disclosure*, Section V.

In addition to the compounds cited previously, the photographic product can contain other photographically useful compounds, for example coating aids, stabilizers, plasticizers, anti-fog agents, antistatic agents, matting agents, etc. Examples of these compounds are described in *Research Disclosure*, Sections VI, VII, VIII, X.

The supports which can be used in photography are described in Section XV of *Research Disclosure*. These supports are generally polymer supports such as cellulose, polystyrene, polyamide, polyvinyl, polyethylene or polyester polymers or paper or metal supports.

The photographic products can contain other layers, for example a protective top layer, intermediate layers, an antihalation layer, an antistatic layer, etc. These various layers and their arrangement are described in Section XI of *Research Disclosure*.

The photographic products of the invention can advantageously be used in the field of graphic arts, by virtue of their high contrast. The emulsions generally used in this type of film are chlorobromide emulsions having a chloride content above 50 mol %, preferably around 70 mol %. These photographic products generally have a silver content of between 20 and 40 g/m$^2$, with a ratio by weight of gelatin to silver of between 0.5 and 5, preferably between 1 and 4.

Photographic products for graphic art are sensitized with dyes which chromatize the emulsion either to red or to blue.

The photographic products of the invention are described in detail in the following examples.

EXAMPLES

The following examples which illustrate the present invention were obtained with a photographic product which comprises an ESTAR® polyethylene polyterephthalate support covered with an intermediate layer of gelatin (1.8 g/m$^2$) containing the hydrazine nucleation agent of formula (I) (0.06 mg/dm$^2$), the amino incorporated booster of formula (II) (0.5 mg/dm$^2$), a latex of formula (III) (4 mg/dm$^2$), and a hardening agent (bisvinylmethylsulfone, 3.5% by weight based on the total dry gelatin).

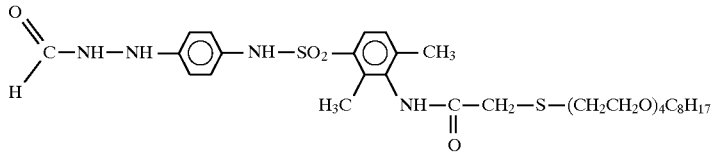

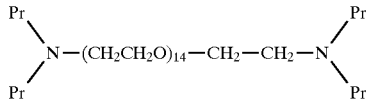

Pr being n-propyl

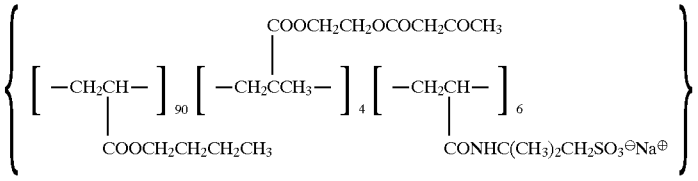

The hydrazine compound was introduced into the photographic product in the form of an alcohol solution and the amino compound in the form of an aqueous solution.

When the developing agent and/or co-developer were present (see table below), they were incorporated into the same intermediate layer.

The intermediate layer was covered with a layer of silver halide emulsion, itself covered with a protective top layer of gelatin (0.8 g/m$^2$)

The silver halide emulsion consisted of cubic grains (0.2 $\mu$m edge) of silver chlorobromide (70 mol % of chloride) doped with rhodium. The grains were chemically sensitized with sulfur ($2.98\times10^{18}$ atoms of sulfur/mol Ag) and with gold ($3.50\times10^{18}$ atoms of gold/mol Ag).

The photographic product was blue-sensitized spectrally with a spectral sensitizer having a maximum absorption around 490 nm.

The silver content of the emulsion layer was 3.2 g/m$^2$. The gelatin content was 2 g/m$^2$.

The photographic product described above was exposed through a sensitometric wedge with 18 steps (increments of 0.1) with a xenon flash exposure meter for 2 microseconds through a colored filter approximately simulating the emission of a blue CRT.

After the film has been developed according to the operating method described hereinafter, the following sensitometric parameters are determined:

Dmin (density of support+fog)

Dmax (point of maximum density)

Effective contrast (EC) (slope of the sensitometric curve measured between a density of 0.1 and 2.5.

Toe contrast (TC) of the sensitometric curve (slope of the sensitometric curve measured between a density of 0.1 and 0.6).

Speed of the film measured for a density of 4 above the minimum density ($R_{D=4}$).

Speed of the film measured for a density of 2 above the minimum density ($R_{D=2}$).

EXAMPLE 1 (INVENTION)

Once the film described above was exposed, a layer of around 20 ml/m$^2$ of activator was applied to the film, the activator having the following composition in which the quantity of quaternary ammonium was varied between 0 and 5 g/l.

| Composition of the activator | |
|---|---|
| 2-methylaminoethanol | 70 g/l (1 mol./l) |
| KBr | 5 g/l |
| $Na_2SO_3$ | 75 g/l |
| Wetting agent OLIN 10G ® | 0.6% by vol of activator |
| 1-phenethyl-2-methyl pyridinium bromide | 0 to 5 g/l |
| 5-nitroindazole | 0.1 g/l |
| KOH | to obtain a pH of 12 |

The following sensitometric results were obtained.

TABLE 1

| | Quantity of ammonium salt | Dmax | TC | EC | $R_{D=4}$(*) |
|---|---|---|---|---|---|
| Ex 1.1 | 0 g/l | 4.3 | 8.7 | 6.6 | 100 |
| Ex 1.2 | 2 g/l | 4.7 | 12.7 | 24.1 | 120 |
| Ex 1.3 | 5 g/l | 4.7 | 9.7 | 19.21 | 121 |

(*)standardized to 100

These examples show that the presence of the quaternary ammonium salt is necessary to obtain a high contrast.

EXAMPLE 2

Once the film described above was exposed, a layer of around 20 ml/m$^2$ of activator was applied to the film, the activator having the following compositions:

| | Ex 2.1 | Ex 2.2 | Ex 2.3 | Ex 2.4 | Ex 2.5 | Ex 2.6 | Ex 2.7 | Ex 2.8 |
|---|---|---|---|---|---|---|---|---|
| 2-MAE (*) (g/l) | 70 | — | — | — | — | 35 | 35 | 50 |
| $Na_2HPO_4$ (g/l) | — | 20 | 30 | — | — | 20 | — | — |
| $K_2CO_3$ (g/l) | — | — | — | 20 | 30 | — | 20 | — |
| 5-Nitro-indazole (g/l) | 0.2 | 0.2 | 0.2 | 0.2 | 0.2 | 0.2 | 0.2 | 0.2 |
| KBr (g/l) | 5 | 5 | 5 | 5 | 5 | 5 | 5 | 5 |
| $K_2SO_3$ (g/l) | 99 | 99 | 99 | 99 | 99 | 99 | 99 | 99 |
| Lodyne-s-100 ® (% vol) | 0.75 | 0.75 | 0.75 | 0.75 | 0.75 | 0.75 | 0.75 | 0.75 |
| PMPB (**) (g/l) | 2 | 2 | 2 | 2 | 2 | 2 | 2 | 2 |
| pH (***) | 12 | 12 | 12 | 12 | 12 | 12 | 12 | 12 |

(*) 2-methylaminoethanol
(**) 1-phenethyl-2-methyl pyridinium bromide
(***) if required, additional KOH to obtain a pH of 12.

The following sensitometric results were obtained.

TABLE 2

| | Ex 2.1 | Ex 2.2 | Ex 2.3 | Ex 2.4 | Ex 2.5 | Ex 2.6 | Ex 2.7 | Ex 2.9 |
|---|---|---|---|---|---|---|---|---|
| Dmin | 0.03 | 0.03 | 0.03 | 0.024 | 0.026 | 0.037 | 0.035 | 0.034 |
| Dmax | 4.9 | 1.5 | 1.99 | 2.03 | 2.53 | 4.96 | 4.73 | 4.7 |
| $R_{D=2}$ | 100 | — (*) | — (*) | 81 | 88.9 | 97.3 | 95.4 | 99.5 |
| TC | 11.23 | 2.76 | 3.4 | 2.74 | 2.95 | 8.9 | 6.32 | 9.84 |
| EC | 21.05 | — (*) | — (*) | — (*) | 3.6 | 17.4 | 12.7 | 17.5 |

(*) not measurable
$R_{D=2}$ Standardized to 100

Example 2.1 which illustrates the present invention shows that a quantity of methylethanolamine of 70 g/l (1 mol./l) improves the sensitometric properties of the photographic product. In particular, a significant increase in contrast and speed was noted. Examples 2.6, 2.7 and 2.8 show that this improvement is obtained with 50 g/l of methylethanolamine (0.66 mol/l).

Examples 2.2 to 2.5 show that a basic solution which contains no alcanoamine does not afford the improved sensitometric results obtained in the invention.

EXAMPLE 3

Once the film described above was exposed, a layer of around 20 ml/m$^2$ of activator was applied to the film, the activator having the following composition.

| Composition of the activator | |
|---|---|
| 2-methylaminoethanol | 70 g/l (1 mol./1) |
| KBr | 5 g/l |
| $Na_2SO_3$ | 75 g/l |
| Wetting agent OLIN 10G ® | 0.6% by vol of activator |
| 1-phenethyl-2-methyl pyridinium bromide | 0 to 6.5 g/l |
| Anti-fog agent | (see Table 3) |
| KOH | to obtain a pH of 12 |

In this activator, the nitroindazole anti-fog compound has been replaced with conventional anti-fog agents. In Example 3.1, the anti-fog agent used was 5-methyl-benzotriazole (MBT). In Example 3.2, the anti-fog agent was phenyl mercaptotetrazole (PMT).

The following sensitometric results were obtained.

TABLE 3

| | Anti-fog agent | | Dmin | TC | EC |
|---|---|---|---|---|---|
| Ex 3.1 | MBT | (0.2 g/l) | 0.71 | 2.93 | 5.97 |
| | | (0.4 g/l) | 0.10 | 2.33 | 6.17 |
| EX 3.2 | PMT | (0.1 g/l)* | — | — | — |

*The films obtained were totally fogged. The sensitometric results were unusable.

These examples show that the choice of the anti-fog compound is very important in the invention. The presence of MBT or PMT inhibits development.

EXAMPLE 4

After exposing a film as described above in Example 1, this film was developed by immersion in a 1 liter tank containing the activator with the following composition:

| Composition of the activator | |
|---|---|
| 2-methylaminoethanol | 70 g/l (1 mol./1) |
| KBr | 5 g/l |
| $Na_2SO_3$ | 75 g/l |
| Wetting agent OLIN 10G ® | 0.6% by vol of activator |
| 1-phenethyl-2-methyl pyridinium bromide | 2 g/l |
| 5-nitroindazole | 0.1 g/l |
| KOH | to obtain a pH of 12 |

The following sensitometric results were obtained:

TABLE 4

| | Dmax | TC | EC |
|---|---|---|---|
| Ex 4 | 4.20 | 5.5 | 5.13 |

These results show that when a film containing a developer, a nucleation agent and an booster is developed in a tank, nucleation of grains does not occur.

The invention has been described in detail with particular reference to certain preferred embodiments thereof, but it will be understood that variations and modifications can be effected within the spirit and scope of the invention.

I claim:

1. A method for processing an exposed silver halide photographic product comprising a support having thereon a silver halide emulsion layer, said method comprising applying to said photographic product, a layer of an activator, wherein A. said photographic product comprises:
(1) a hydrazine nucleation agent,
(2) an incorporated amino booster, and
(3) a developing agent for silver halides capable, in its oxidized form, of oxidizing hydrazine, and B. said activator being a homogeneous aqueous solution of (a) an alkanolamine in a quantity greater than or equal to 0.6 mol/l, (b) a quaternary ammonium salt, (c) at least one high pH resistant wetting agent miscible in said activator and (d) a nitroindazole anti-fog compound.

2. The method of claim 1 wherein said hydrazine has the formula:

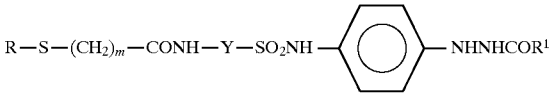

wherein R is a monovalent group having at least 3 ethyleneoxy units, m is an integer between 1 and 6, Y is a substituted or unsubstituted divalent aromatic radical, and $R^1$ is hydrogen or a blocking group.

3. The method of claim 2 wherein Y is a phenylene or naphthalene radical that can be substituted by one or more alkyl, halo, alkoxy, haloalkyl or alkoxyalkyl substituents.

4. The method of claim 1 wherein said amino booster is a tertiary diamine that has a partition coefficient of at least 3 and a formula:

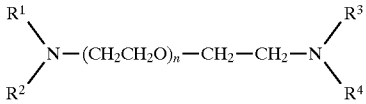

wherein n is an integer between 3 and 50, $R^1$, $R^2$, $R^3$ and $R^4$ are independently alkyl groups each having 1 to 8 carbon atoms, $R^1$ and $R^2$ taken together represent the atoms needed to form a heterocyclic ring, and $R^3$ and $R^4$ taken together represent the atoms needed to form a heterocyclic ring.

5. The method of claim 1 wherein said quaternary ammonium salt has the formula:

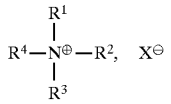

(I)

wherein $R^1{}_1$, $R^2$, $R^3$ and $R^4$ are independently hydrogen, an alkyl group having 1 to 4 carbon atoms, an aromatic group which may contain one or more nitrogen atoms, or $R^1$ and $R^2$ together, or $R^1$, $R^2$ and $R^3$ together can represent the atoms or bonds needed to form an aromatic or non-aromatic ring having 5 or 6 atoms in the ring, and X is a counter-ion that balances the charge of the molecule.

6. The method of claim 5 wherein $R^1$, $R^2$ and $R^3$ together represent the atoms needed to form a pyridinium heterocyclic ring.

7. The method of claim 5 wherein at least one of the groups $R^1$, $R^2$ and $R^3$ is an aryl group.

8. The method of claim 5 wherein said quaternary ammonium salt is 1-phenethyl-2-methyl pyridinium.

9. The method of claim 1 wherein said anti-fog compound is a 5-nitroindazole or 6-nitroindazole.

10. The method of claim 1 wherein the volume of said activator solution used is from 20 to 200 ml/$m^2$ of photographic product to be developed.

11. The method of claim 1 wherein said developing agent is hydroquinone or methylhydroquinone.

12. The method of claim 1 that additionally uses a 3-pyrazolidinone co-developer in association with said developing agent.

13. The method of claim 1 wherein said developing agent, said hydrazine nucleation agent and said amino booster are present in an intermediate layer of said photographic product, said intermediate layer being adjacent to said silver halide emulsion layer, and also being situated between said support and said silver halide emulsion layer.

14. The method of claim 1 wherein said activator is free of photographic developing agent.

15. The method of claim 1 wherein said activator comprises an aqueous solution of:

(a) an alkanolamine in a quantity greater than or equal to 0.6 mol/l, (b) 0.1 to 20 g/l of a quaternary ammonium salt, (c) 0.1 to 3% by volume of activator of at least one high pH resistant wetting agent miscible in said activator, and (d) 0.05 to 0.7 g/l of a nitroindazole anti-fog compound.

16. The method of claim 15 wherein said alkanolamine is present at from 0.8 to 1.5 mol/l.

17. The method of claim 15 wherein said quaternary ammonium salt is present at from 1 to 10 g/l.

18. The method of claim 1 wherein said alkanolamine is monoethanolamine, diethanolamine or 2-alkylethanolamines.

19. The method of claim 1 wherein said silver halide emulsion has silver halide grains comprising at least 50% mol silver chloride.

* * * * *